United States Patent [19]

Lupo

[11] 4,123,816

[45] Nov. 7, 1978

[54] FINGERNAIL CLEANING APPARATUS

[76] Inventor: Peter J. Lupo, 51-35 72nd St., Woodside, N.Y. 11377

[21] Appl. No.: 813,966

[22] Filed: Jul. 8, 1977

[51] Int. Cl.[2] ..... A46B 13/04

[52] U.S. Cl. ..... 15/21 D

[58] Field of Search ..... 15/21 R, 21 C, 21 D, 15/38, 39, 74, 97 R, 21 E

[56] References Cited

U.S. PATENT DOCUMENTS

| | | | |
|---|---|---|---|
| 2,036,840 | 4/1936 | Thiesen | 15/39 |
| 2,704,374 | 3/1955 | Barklow | 15/39 |
| 2,973,534 | 3/1961 | Gilderbloom | 15/74 |
| 3,000,027 | 9/1961 | Swords | 15/21 D |
| 3,008,161 | 11/1961 | Jensen | 15/21 D |
| 3,081,471 | 3/1963 | Newell | 15/21 D |
| 3,691,577 | 9/1972 | Bliss | 15/21 D |

FOREIGN PATENT DOCUMENTS

| | | | |
|---|---|---|---|
| 2,262,504 | 9/1975 | France | 15/21 D |

*Primary Examiner*—Edward L. Roberts

[57] ABSTRACT

Fingernail cleaning apparatus includes an electric motor having a drive shaft. A bristle brush is drivably connected to the motor drive shaft for rotation therewith. A reservoir for a cleaning liquid is positioned beneath the brush in such relation therewith that the bristles of the brush are rotatable within the confines of the reservoir. A base supports the motor and has partitions or supports for the drive shaft and brush. A housing encloses at least the brush and reservoir so as to shield the motor and the user of the apparatus from any spray of cleaning liquid generated.

7 Claims, 4 Drawing Figures

FINGERNAIL CLEANING APPARATUS

BACKGROUND OF THE INVENTION

The present invention relates to fingernail cleaning apparatus and more particularly to a unit capable of simultaneously washing and brushing the fingernails.

Tne need for fingernail cleaning apparatus has been receognized heretofore and devices of various types have been available. For example, there have been rotary brushes by means of which a single fingernail can be cleaned. However, the use of such prior devices is time consuming in that only a single fingernail may be cleaned at a time and it is frequently desirable to intermittently apply a cleaning liquid to the fingernails. Further, there is need in beauty salons and like commercial establishments for apparatus which can be located in an area of the premises where a customer can, as a preliminary treatment, clean one's fingernails without requiring the attendance of a beautician, thereby preparing such fingernails for subsequent personalized cosmetic finishing treatment by the beautician.

SUMMARY OF THE INVENTION

It is one object of the invention to provide fingernail cleaning apparatus by means of which all of the fingernails on a person's hand are simultaneously cleaned.

It is another object of the invention to provide fingernail cleaning apparatus by means of which one's fingernails may be washed and brushed in concurrent operations.

It is yet another object of the invention to provide fingernail cleaning apparatus by means of which one can wash and brush the fingernails in a semi-automatic manner without the services of an attendant.

Other objects and advantages of the invention will become readily apparent from the following description of the invention.

According to the present invention, there is provided a fingernail cleaning apparatus comprising in combination electric motor means including a drive shaft; a brush drivably connected to the drive shaft for rotation therewith; a reservoir for cleansing liquid positioned adjacent the brush; and housing means enclosing at least the brush and reservoir, the housing means having an aperture dimensioned so as to permit the insertion therethrough of a person's hand for the cleaning of the fingernails thereof by contact with the brush.

BRIEF DESCRIPTION OF THE DRAWINGS

In order that the invention may be more fully understood, it will now be described, by way of example, with reference to the accompanying drawings in which.

DETAILED DESCRIPTION OF THE INVENTION

Figure 1:
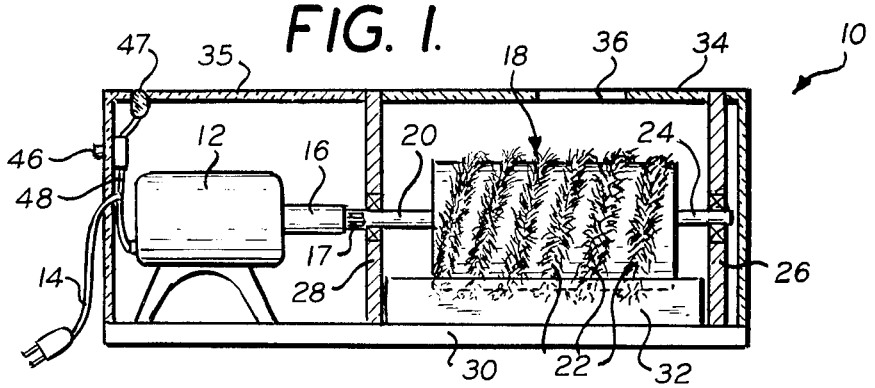
FIG. 1 is a side elevational view of fingernail cleaning apparatus embodying the features of the invention.

Referring to the drawings, there is shown generally by reference numeral 10 fingernail cleaning apparatus. Such apparatus includes motor 12 which is desirably of the type which develops relatively high torque and low rotational speeds. The motor may be battery powdered or provided with a power cord 14 for connection with the line voltage of a building in conventional manner. The motor includes drive shaft 16. Where necessary, reduction gearing (not shown) may be employed.

Figure 3:
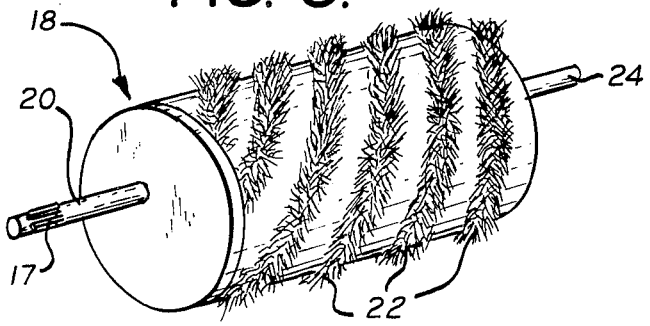
FIG. 3 is a perspective view of a preferred brush construction.

A brush 18, preferably of the bristle type, is mounted so as to be drivably connected to the motor drive shaft. Thus, the core 20 of the brush and motor drive shaft 16 may be splined as at 17 or otherwise keyed for simultaneous rotation. As previously stated, brush 18 is preferably of the bristle type and, as shown in FIG. 3, the bristles 22 are desirably arranged in spiral configuration. The end of the core 20 remote from drive shaft 16 may be provided with a nipple 24 dimensioned to be supported within a seat on a partition 26. A partition 28 is also desirably provided to rotatably support the end of the core 20 operatively connected to the motor drive shaft. Partitions 26, 28 may be formed integrally with a base member 30, such base member serving to support motor 12 and a reservoir 32 positioned beneath the brush. The reservoir is adapted to contain water or another suitable cleaning liquid.

An enclosure 34 surmounts the base member and is desirably formed of a transparent synthetic plastics material and dimensioned to extend over the partitions 26 and 28 in sealing engagement with them to enclose the brush and reservoir. Preferably, the cover and base are provided with cooperable engaging means allowing the cover to be removably secured. A second cover 35 is placed over the motor 12. This latter cover may be more securely fastened in place as by screws. If desired, the peripheral edge of the base member and the lower edge of the enclosure may be given complementary configurations and may include a peripherally extending sealing member so as to insure that there is no leakage of liquid from the region of the apparatus containing the brush and reservoir. An opening 36 is formed in the upper surface of the enclosure 34 and preferably extends transversely of the brush axis. Such opening is dimensioned to permit the insertion therethrough of a person's hand so that the fingers may be positioned along the direction of rotation of the brush. As can be seen most clearly from FIGS. 1 and 4, enclosure 34 or 38 may be contoured to present a recessed or trough-like region 38 which may be employed as a receptacle for various cleaning implements such as a nail file, soap or like articles. The enclosure, in combination with partitions 26, 28 also prevents the spraying of water from the rotating brush exteriorly of the region between the partitions to thus protect the user of the apparatus and motor 12. It will be understood, of course, that the motor may be of the hermetically sealed type so that even if partition 28 is dispensed with and substituted by a skeletal support for the motor shaft and brush core, there will be no danger of any damage to the motor from water which may impinge thereupon. It will also be appreciated that, if desired, the enclosure 34 may be formed as a single unitary member.

Figure 4:
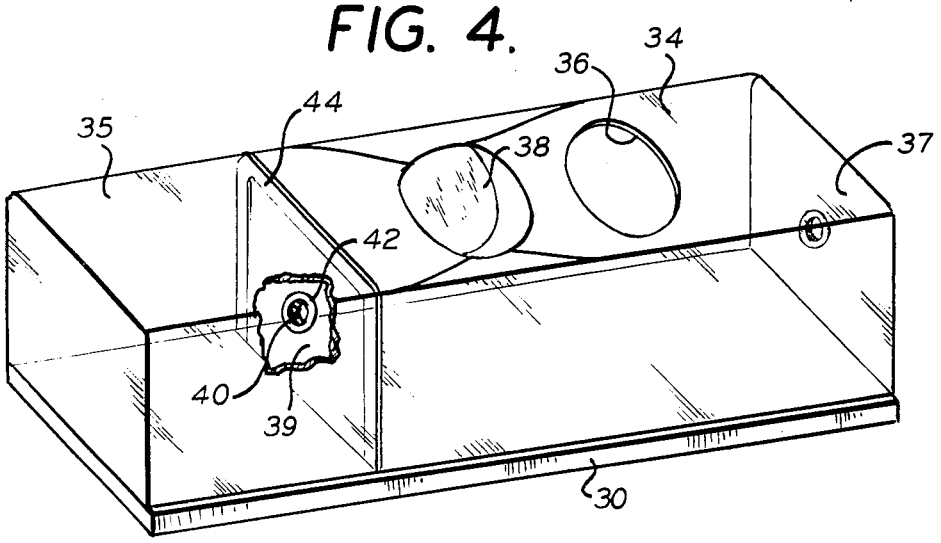
FIG. 4 is a perspective view of a modified form of base and enclosure.

As shown in FIG. 4, section 34 may be provided with end walls 37 and 39 in the latter of which with an aperture 40 dimensioned to accommodate one end of brush core 20 rotatably therein. A ball or roller bearing race 42 may be employed within aperture 40 to rotatably support the core 20. Section 35 may be open ended at its point of abutment with section 34. With this form of enclosure, it is contemplated that partitions 26, 28 may be dispensed with since the end walls 37, 39 of section 34 serve as support members for the brush core and also prevent the splashing of liquid on the motor and user of the device. A sealing gasket 44 may desirably extend peripherally about the edge of end wall 39 adapted to receive the edge portion of section 36 in sealing relation.

Referring to FIG. 1, it will be observed that the brush is so mounted as to have the lower periphery thereof extend below the level of liquid in and within the confines of reservoir 32. In this manner, rotation of the brush results in the pick-up of a quantity of water from the reservoir for application to the fingernails of the user concomitant with the brushing of the nails by the brush.

Figure 2:
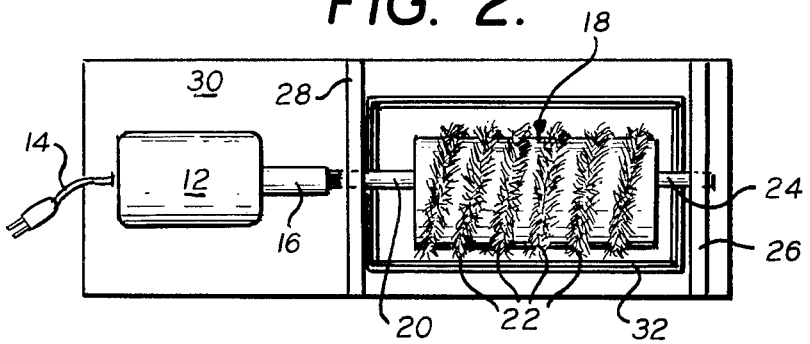
FIG. 2 is a top plan view of the fingernail cleaning apparatus of FIG. 1.

It has been found that the mounting of the brush eccentrically upon the motor drive shaft, as can be seen most clearly from FIG. 2, results in a unique cleansing action and, under certain circumstances, may be particularly desirable. The eccentric mounting of the brush, for example, leads to involuntary movement of the hand in oscillatory fashion against the brush with consequent improved cleansing of the fingernails. It will be understood that, in such event, the support structure for the drive end of the brush core should be modified to accommodate the additional vibratory forces developed.

Although not specifically illustrated and described herein, it will be appreciated that enclosure section 35 may be provided with one or more vent apertures to prevent the accumulation of heat generated by motor 12. Also, a necessary control switch for the motor may be provided on the base or on the preferably fixed enclosure section 35. Cord 14 may, if desired, have a branch 48 connected to an on-off switch 46 which, in turn, is operatively connected to a light 47 to provide an indication that the apparatus is in operation. Such enclosures, and when desired also the base, may be fabricated in attractive colors.

From the foregoing description of the invention, it will be seen that fingernail cleaning apparatus has been provided which achieves the stated objectives.

Various changes, modifications and embodiments have been suggested in the foregoing description, other will be obvious to those skilled in the art. It is intended therefore that the present disclosure be taken as illustrative only and not as limiting of the present invention.

What is cleamed is:

1. Fingernail cleaning apparatus comprising in combination a housing, an electric motor means including a drive shaft and a brush drivably connected to said drive shaft for rotation therewith located within said housing along a generally horizontal axis, a reservoir for a cleaning liquid positioned within said housing below said brush; said brush comprises a series of bristles arranged spirally about the axis of rotation, and extending radially at least in part into said reservoir; said housing means having an oval aperture dimensioned so as to permit the insertion therethrough of a person's hand for the cleaning of the fingernails thereof by contact with said brush, said aperture having a long axis extending transversely to the axis of rotation of the brush and a short axis parallel to said brush, whereby the bristles rotate generally parallel to the fingernail.

2. Fingernail cleaning apparatus according to claim 1, including a base for supporting said electrical motor means and said reservoir, first and second partitions being provided for respectively rotatably supporting said motor drive shaft and shielding the motor from spraying liquid and for supporting the end of said brush remote from its connection with said motor drive shaft.

3. Fingernail cleaning apparatus according to claim 2, wherein said first and second partitions are integral with said base.

4. Fingernail cleaning apparatus according to claim 2, wherein said housing means comprises an enclosure removably positionable on said base in sealing relation therewith.

5. Fingernail cleaning apparatus according to claim 4, wherein said enclosure includes first and second releasably connected sections, said first section being positionable over said motor means to enclose same and said second section being positionable over said brush and reservoir to enclose said brush and reservoir.

6. Fingernail cleaning apparatus according to claim 1, wherein said brush is mounted eccentrically on said drive shaft.

7. Fingernail cleaning apparatus according to claim 2, wherein said reservoir is integral with said base.

* * * * *